US009329004B2

(12) United States Patent
Pace

(10) Patent No.: US 9,329,004 B2
(45) Date of Patent: May 3, 2016

(54) MUNITION HAVING A REUSABLE HOUSING ASSEMBLY AND A REMOVABLE POWDER CHAMBER

(71) Applicant: Scot M Pace, Odessa, FL (US)

(72) Inventor: Scot M Pace, Odessa, FL (US)

( * ) Notice: Subject to any disclaimer, the term of this patent is extended or adjusted under 35 U.S.C. 154(b) by 146 days.

(21) Appl. No.: 14/273,018

(22) Filed: May 8, 2014

(65) Prior Publication Data

US 2016/0003586 A1 Jan. 7, 2016

(51) Int. Cl.

| | |
|---|---|
| ***F42B 5/26*** | (2006.01) |
| ***F42B 33/00*** | (2006.01) |
| ***F42B 5/285*** | (2006.01) |
| ***F42B 5/307*** | (2006.01) |
| ***F42C 19/08*** | (2006.01) |

(52) U.S. Cl.
CPC . *F42B 5/26* (2013.01); *F42B 5/285* (2013.01); *F42B 5/307* (2013.01); *F42B 33/001* (2013.01); *F42C 19/083* (2013.01)

(58) Field of Classification Search
CPC ..... F42B 7/02; F42B 7/12; F42B 5/26; F42B 33/001
USPC ..... 102/464, 430, 444, 439, 445, 446, 482, 102/447
See application file for complete search history.

(56) References Cited

U.S. PATENT DOCUMENTS

2005/0268808 A1* 12/2005 Werner ..... F42B 5/26 102/470

* cited by examiner

*Primary Examiner* — Reginald Tillman, Jr.
(74) *Attorney, Agent, or Firm* — Inventions International Inc.; Tiffany C. Miller

(57) ABSTRACT

A reusable shell casing having a housing with exterior grooves having a substantially central bore with a tapered end capable of receiving a payload and an opposite threaded end adapted to receive a novel reusable high pressure chamber assembly containing a removable powder chamber, a burst disk, and a threaded insert. The chamber assembly has a central bore having an upper bore portion that is cylindrically shaped having a threaded surface adapted to secure to the threaded portion of a threaded insert. The central bore also has a lower bore portion that is cylindrically shaped having a surface that is adapted to closely contour the circumference of the removable powder chamber. The powder chamber has a primary end having a primary opening adapted to receive a propellant located opposite a secondary end having a protrusion. The protrusion has a secondary opening adapted to receive a primer.

13 Claims, 10 Drawing Sheets

MUNITION HAVING A REUSABLE HOUSING ASSEMBLY AND A REMOVABLE POWDER CHAMBER

BACKGROUND OF THE INVENTION

1. Field of the Invention

The novel invention relates, generally, to ammunition.

2. Background Art

Currently, ammunition shells have a central bore that is adapted to receive a propellant. The propellant of prior art shells is in direct contact with a surface of the shell bore. U.S. Pat. No. 7,481,167 teaches a fixed munition for use in a barrel of a low-pressure unit having a cylindrical body with a central bore. The central bore receives a propellant, whereby the propellant is in direct contact with a surface of the shell bore. Under a higher pressure condition from the propellant being ignited, damage and ware can occur. Thus, there is a need for a removable powder chamber that can be either replaced or serviced and reused.

A particular failure of the devices of the prior art is the use of a shell casing containing propellant to be received by a high pressure chamber. Such shell casings result in a lower power charge. This embodiment is taught in U.S. Pat. No. 7,481,167.

There are several challenges to overcome with storing a propellant inside the bore of a shell. One challenge being the need to prevent damage to the barrel and firing mechanism when the propellant is under high pressure conditions. The problem with preventing damage to the barrel is determining how to configure the barrel system so the propellant is not in direct contact with the shell bore. Thus, there is a need for an improved barrel system to allow the propellant to release a more powerful charge of approximately 45,000 psi of pressure and not damage the shell while efficiently propelling a projectile.

However, in view of the prior art considered as a whole at the time the present invention was made; it was not obvious to those of ordinary skill in the pertinent art how the identified needs could be fulfilled.

SUMMARY OF THE INVENTION

The long-standing but heretofore unfulfilled need for a munition having a reusable housing assembly adapted to receive a removable powder chamber, a housing with exterior grooves having a substantially central bore with a tapered end capable of receiving a payload and an opposite threaded end adapted to receive a novel high pressure chamber assembly containing a removable powder chamber, a burst disk, and a threaded insert and which also includes improvements that overcome the limitations of prior art high pressure chambers is now met by a new, useful, and non-obvious invention.

The novel reusable shell casing is adapted to fit within including, but not limited to, a grenade launcher or a riffle. It is a preferred embodiment for the shell casing to be a 40 mm cannon round. Although it is also envisioned that the shell casing size include, but not be limited to, 40 mm or 37 mm, the invention is envisioned to be various sizes. The shell casing has a tube housing having a plurality of grooves having a length of approximately 2 inches located thereon the outer surface of the tube housing. In a preferred embodiment, the plurality of grooves has a depth of approximately 1 mm to 2 mm. It is also within the scope of this invention for a surface of the tube housing to not have any grooves.

In a preferred embodiment, the shell casing has a tube housing having a tapered end located opposite an end having an internal threaded surface. The housing has a substantially central bore. The tapered end has an opening adapted to receive a payload including, but not limited to, a shotgun cup, or a shotgun wad. The payload is filled with a projectile including, but not limited to, buckshot, or flechettes. A barrier element including, but not limited to, paper or foam is inserted into the tapered end opening and substantially covers the payload. The end of the tube housing having an internal threaded surface has an opening having a diameter greater than the diameter of the tapered end. The end of the tube housing having an internal threaded surface opening has a step surface adapted to come into contact with the internal shell seating surface of the high pressure chamber assembly.

The high pressure chamber assembly has a base having a primary end located opposite a secondary end. The base is generally made of a light weight alloy including, but not limited to, aluminum, carbon fiber, or high temperature plastic. The primary end is threaded on the exterior surface and has a primary opening that is threaded on a portion of the interior surface. The secondary end of the base has a secondary opening that is smaller in diameter than the primary opening. The primary opening is adapted to receive a removable powder chamber, a burst disk, and a threaded insert. The secondary opening of the base is adapted to closely contour the powder chamber protrusion. The powder chamber protrusion is located on the primer receiving end of the powder chamber.

In a preferred embodiment, the base has an opening to receive a fastener including, but not limited to, a set screw. It is a preferred embodiment that there are three set screw openings on the base. Each of the three openings receives a fastener. The fastener is in contact with a recess located on a surface of the removable powder chamber. The fastener secures the removable powder chamber to the base. It is also envisioned that the removable powder chamber does not need to be secured to the base with a fastener. The removable powder chamber can be secured to the high pressure chamber assembly with a threaded insert.

The base has a central bore having an upper bore portion. The upper bore portion is cylindrically shaped having a threaded surface adapted to secure to the threaded portion of a threaded insert. The central bore also has a lower bore portion that is cylindrically shaped having a surface that is adapted to closely contour the circumference of the removable powder chamber.

This novel invention also includes a removable powder chamber with a primary end having a primary opening adapted to receive a propellant, including but not limited to, smokeless powder, located opposite a secondary end having a protrusion. The protrusion has a secondary opening adapted to receive a primer. The primary opening is adapted to receive a propellant and has a diameter that is larger than the diameter of the secondary opening that is adapted to receive a primer. This removable powder chamber can withstand the higher pressure of the propellant having approximately 45,000 psi of pressure exerted when ignited.

It is a preferred embodiment for the novel removable powder chamber to be constructed of a ridged material. The powder chamber is generally a more robust material than the base including, but not limited to, stainless steel, hardened steel, or titanium. Also, it is envisioned that as more high tech materials are introduced into the market, any material that can withstand the high temperature and pressures generated by an ignited propellant can be used. The powder chamber is inserted into the primary opening of the base. When the powder chamber is positioned to closely contour the lower portion of the base, the powder chamber retainer seat contacts the powder chamber retainer seating surface of the base.

Additionally, the powder chamber protrusion has a circumference that closely contours a surface of the secondary opening of the base.

This novel invention also includes a burst disk that is adapted to be received by the primary opening of the base. The burst disk substantially covers the primary end of the powder chamber that receives the propellant, thereby, sealing the powder chamber opening. The burst disk is kept in place when a threaded insert is received by the primary opening of the base. The secondary end of the threaded insert is in contact with a surface of the burst disk. In a preferred embodiment the burst disk is made of any soft material that can create a barrier that will deform, break up, and be forced through the openings of the threaded insert along with the high pressure gasses. In a preferred embodiment, the burst disk is made of copper. It is within the scope of this invention for the burst disk to be made of any material including, but not limited to, metal, plastic, fiberglass, cardboard, or paper.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
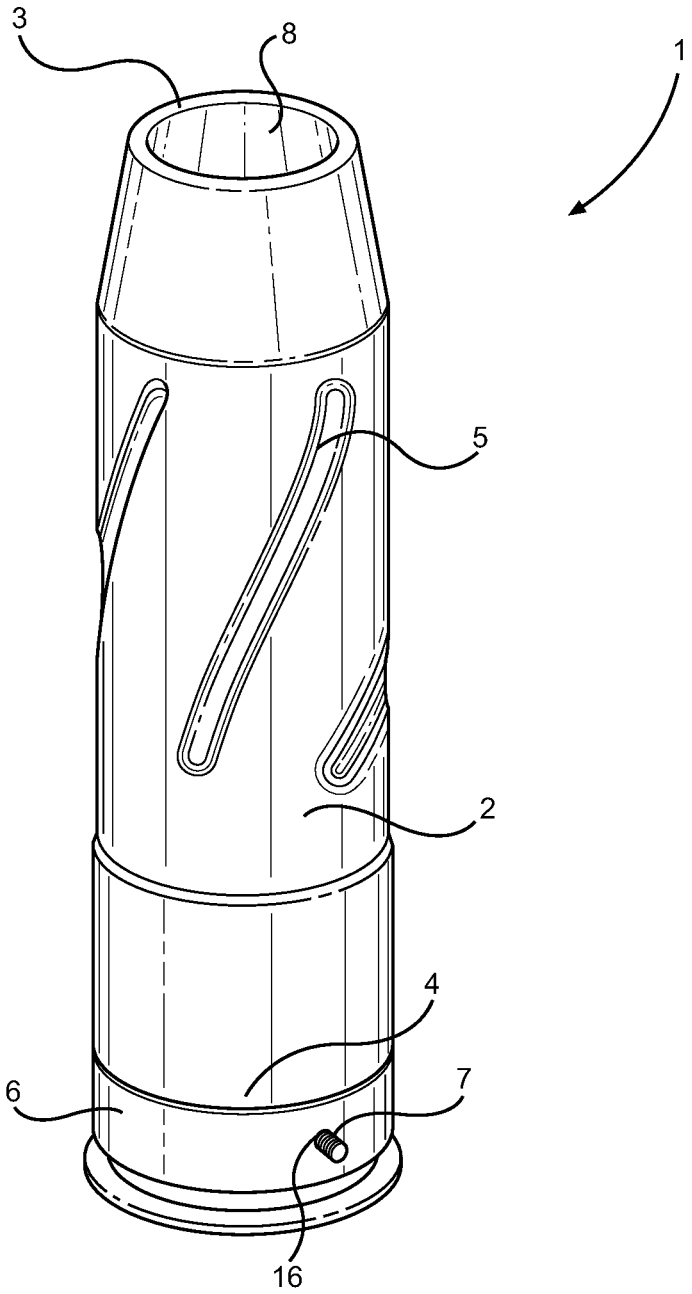
FIG. 1 is a side perspective view of the novel shell housing connected to the base.
Figure 2:
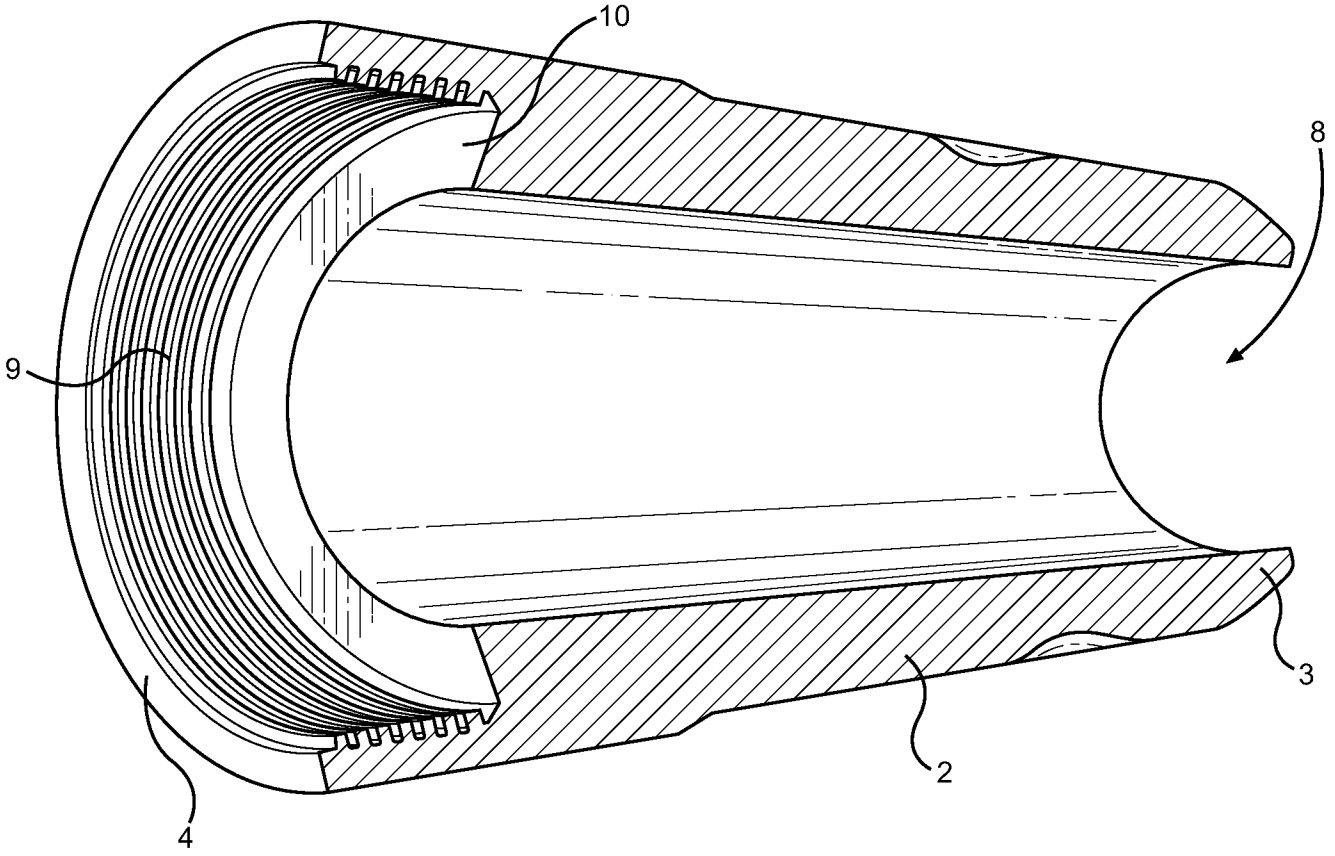
FIG. 2 is a cut-away view of the novel shell housing.

In the following detailed description of the preferred embodiments, reference is made to the accompanying drawings, which form a part hereof, and within which are shown by way of illustration specific embodiments by which the invention may be practiced. It is to be understood that other embodiments may be utilized and structural changes may be made without departing from the scope of the invention.

In a general embodiment the novel munition 1 has a reusable high pressure chamber assembly having a removable high pressure powder chamber 17. The chamber assembly has base 6 having primary end 12 located opposite secondary end 13. Primary end 12 of base 6 has primary opening 14. Secondary end 13 of base 6 has secondary opening 15. Powder chamber 17 having primary end 18 located opposite secondary end 19 is inserted into primary opening 14 of base 6. Powder chamber primary end 18 has opening 30 adapted to receive a propellant (not shown). Powder chamber secondary end 19 has opening 31 to receive a primer (not shown). Powder chamber 17 has powder chamber retainer seat 25 that is configured to mate with seating surface 29 of base 6 when powder chamber 17 is inserted into base 6. Powder chamber secondary end 19 is a protrusion that is received by secondary opening 15 of base 6.

Burst disk 20 substantially covers primary opening 30 of powder chamber 17 to seal high pressure powder chamber 17. Threaded insert 21 has primary end 26 having opening 32 and secondary end 27 with openings 33A-33F. In a preferred embodiment, secondary end 27 of threaded insert 21 has six openings 33A-33F. It is also envisioned that threaded insert 21 is not limited to having six openings. Threaded insert 21 is adapted to retain burst disk 20 against primary opening 30 of powder chamber 17, thereby, retaining burst disk 20 and powder chamber 17 within base 6.

In another embodiment, munition 1 includes a housing assembly having base 6 connected to shell casing 2. Shell casing 2 has discharge end 3 located opposite shell end seat 4. Discharge end 3 has opening 8 adapted to receive payload 11. Shell end seat 4 has opening 9 adapted to receive a portion of base 6.

In another embodiment, shell casing 2 has at least one groove 5 located on a surface thereon. It is a preferred embodiment for at least one groove 5 to have a depth of approximately 1 mm to 2 mm.

Another embodiment includes at least one fastener 7 that contacts a sidewall of powder chamber 17. In a preferred embodiment, three set screws 7 are inserted through three openings 16 of base 6. When set screws 7 are screwed into openings 16 of base 6, set screws 7 contact recess 22 surface of powder chamber 17 and retain powder chamber 17 within base 6.

Construction of the Novel Deformable Pocket

Figure 3:
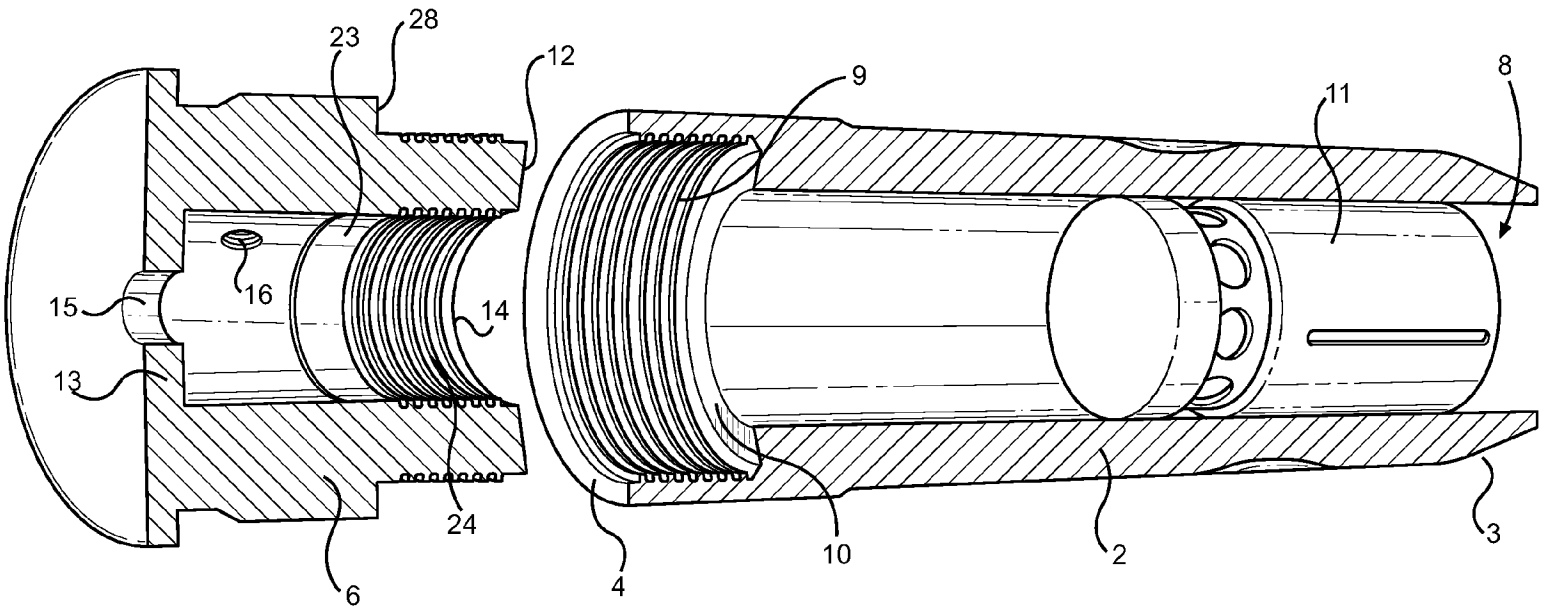
FIG. 3 is an exploded cut-away view of the shell housing and the base.

It will now be seen, referring to FIG. 1, munition 1 includes shell housing 2 having discharge end 3 located opposite shell end seat 4. Discharge end 3 has opening 8. In a preferred embodiment, base 6 has at least one opening 16 (FIGS. 1, 3, and 6) configured to receive at least one fastener 7 including, but not limited to, a set screw. At least one fastener 7 is adapted to retain removable powder chamber 17 (FIG. 4) to base 6. It is also envisioned that powder chamber 17 can be secured to base 6 with threaded insert 21 (FIG. 5) and without the use of fastener 7.

A surface of shell housing 2 can have at least one groove 5 having a depth of including, but not limited to, approximately 1 mm to 2 mm. It is within the scope of this invention for a surface of shell housing 2 to have a plurality of grooves 5. The shallower the depth of grooves 5 prevents shell wall 2 from cracking due to an increased thickness of the side wall of shell housing 2. The sidewall of munition 1 can be highly polished and can be slick from the sidewall being anodized. For handling purposes, grooves 5 act as a slip-resistant grip so munition 1 will not slip from a user's hand (not shown). If grooves 5 are too deep, it will reduce the structural integrity of shell housing 2. Grooves 5 make it easier for a user to handle munition 1 because the use of munitions are generally in conditions that expose munition 1 to including, but not limited to, rain, dust, sweat, snow, or mud which can contribute to munition 1 being slick to handle. Grooves 5 are placed at an angle on the surface of shell housing 2 to create a grip between a user's hand and munition 1 such as a tread on a tire creates a grip between a tire and the road.

FIGS. 2, 3, 4, 5, and 10 depict shell housing 2 having discharge end 3 located opposite shell end seat 4. Discharge end 3 has opening 8. Shell end seat 4 has opening 9 with internal shell seat 10. Payload 11 (FIGS. 3 and 5) is received by opening 8. A portion of the surface of the inner wall of opening 9 is threaded to receive an exterior threaded portion of base 6. Internal shell seating surface 12 of base 6 is adapted to come into contact with internal shell seat 10 of shell housing 2 (FIGS. 2-4, and 10). Base 6 has shell end seating surface 28 that is adapted to come into contact with shell end seat 4 of shell housing 2.

Figure 4:
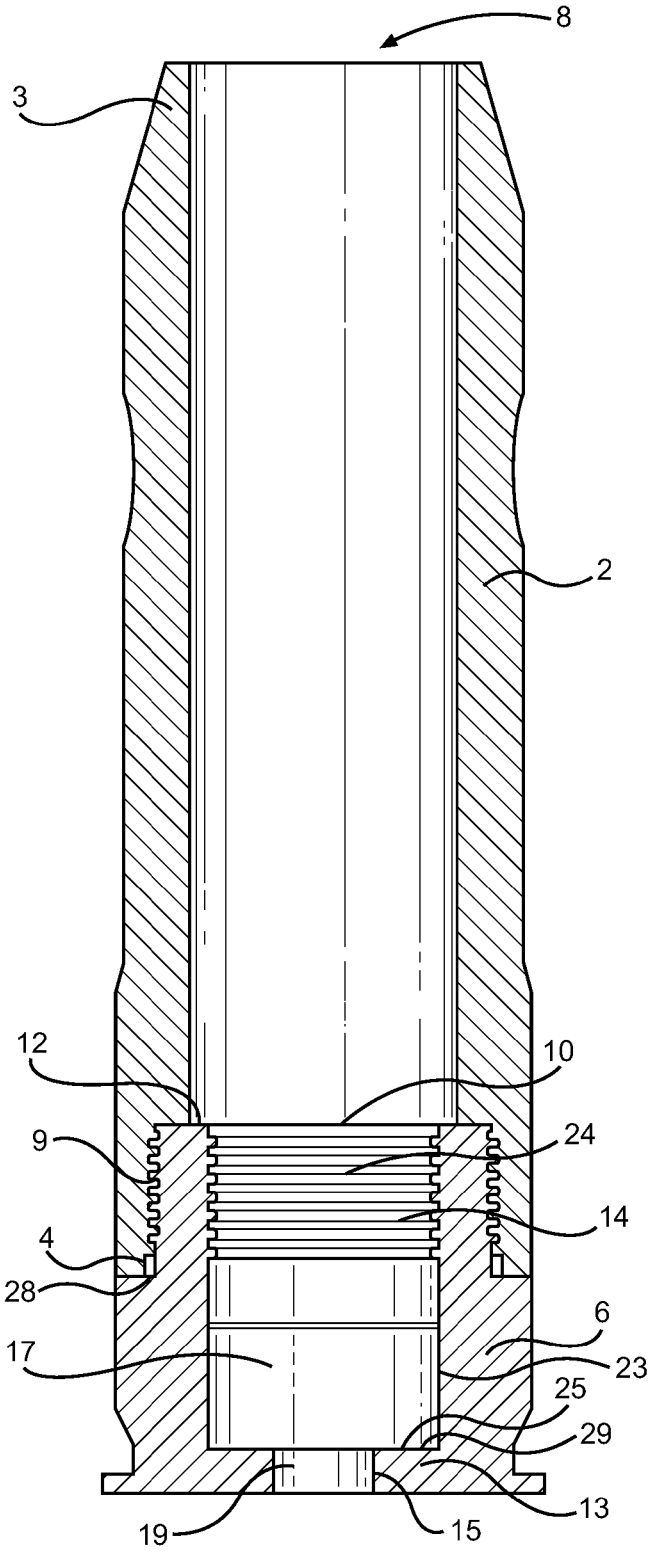
FIG. 4 is a cut-away view of the shell housing and base having a removable powder chamber.
Figure 5:
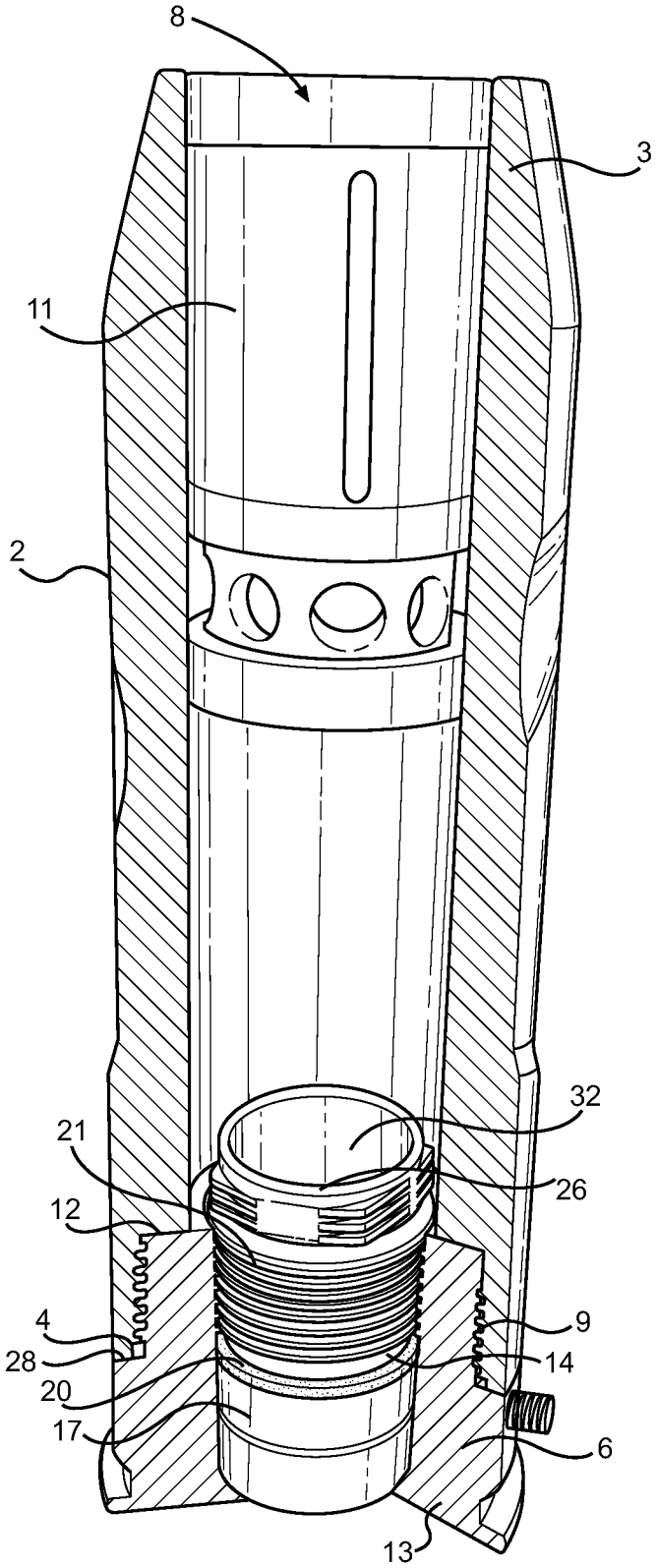
FIG. 5 is a cut-away view of the shell housing and base having a removable powder chamber, burst disk, and a threaded insert.
Figure 7:
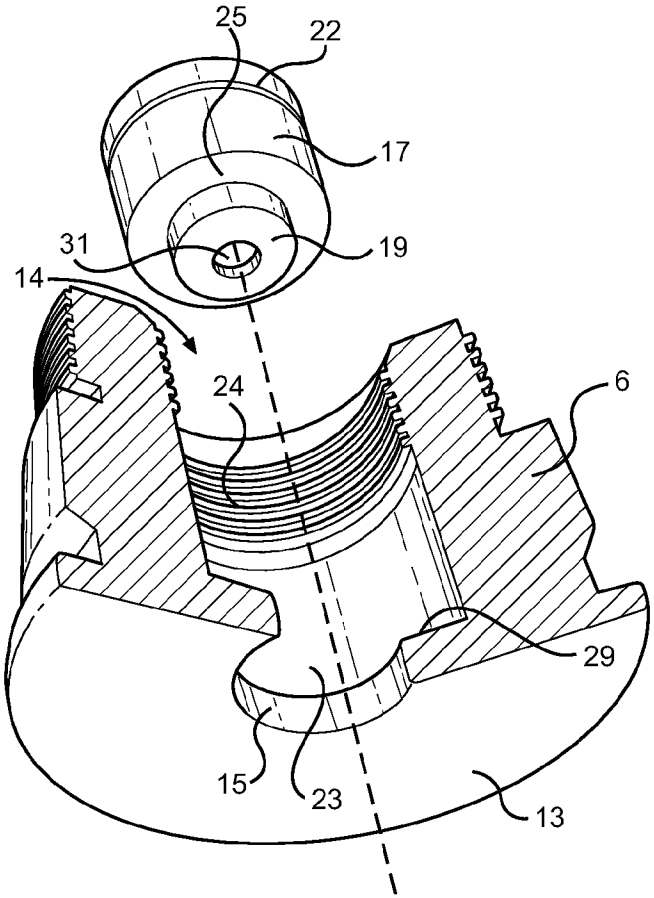
FIG. 7 is an exploded cut-away view of the base having a removable powder chamber.

Base 6 has base end 12 having opening 14 adapted to receive removable powder chamber 17 (FIGS. 4, 5, 7, and 10). Base end 12 is located opposite base end 13. Base end 13 has opening 15 (FIGS. 3, 4, 7, and 10). Opening 15 is adapted to receive powder chamber secondary end 19 (FIGS. 4, 6-8, and 10). As best shown in FIGS. 3, 4, 7, and 10, base 6 has lower bore portion 23 and upper bore portion 24. Lower bore portion 23 has a cylindrical shaped surface that closely contours the circumference of powder chamber 17 (FIGS. 4 and 7). Upper bore portion 24 has a cylindrically shaped surface that is threaded to receive threaded insert 21 (FIG. 5).

Figure 13:
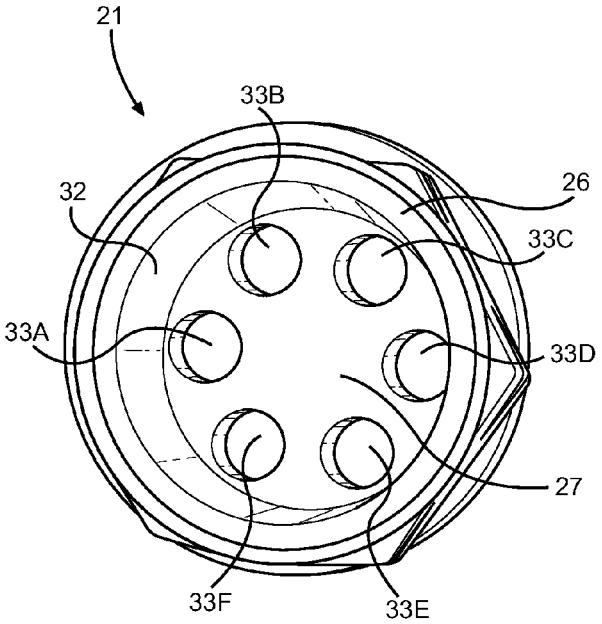
FIG. 13 is a top view of the threaded insert.

FIGS. 5 and 13 show threaded insert 21 having threaded insert primary end 26 with opening 32. As best shown in FIG. 13, threaded insert 21 has secondary end 27 with plurality of openings 33A, 33B, 33C, 33D, 33E, and 33F. Threaded insert 21 acts as a screw-in vent plug adapted for a surface of threaded insert secondary end 27 to contact a surface of burst disk 20.

Figure 10:
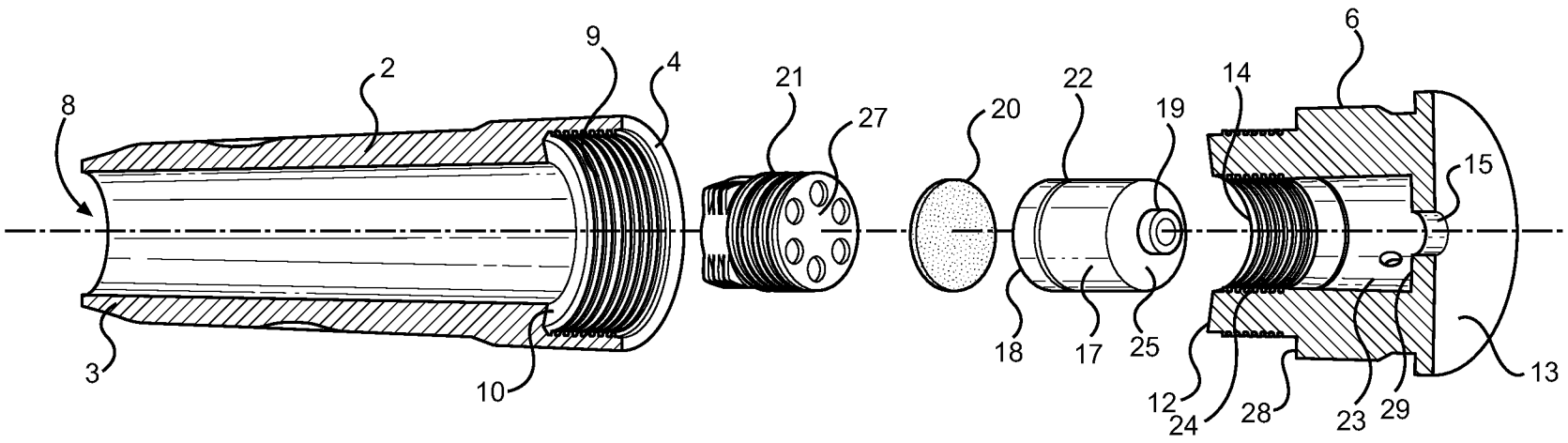
FIG. 10 is an exploded cut-away view of the shell housing and the base having a removable powder chamber, a burst disk, and a threaded insert.

FIGS. 5 and 10 illustrate burst disk 20 is adapted to abut powder chamber primary end 18 and threaded insert secondary end 27.

FIGS. 4, 7, 8, and 10 best depict removable powder chamber 17 having powder chamber retainer seat 25 adapted to come into contact with powder chamber retainer seating surface 29 of base 6.

Figure 6:
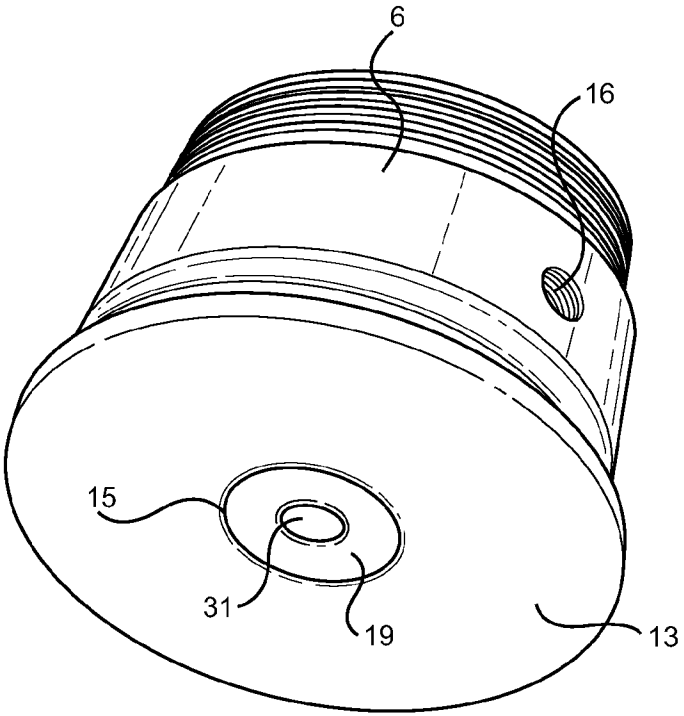
FIG. 6 is a bottom view of the base.
Figure 8:
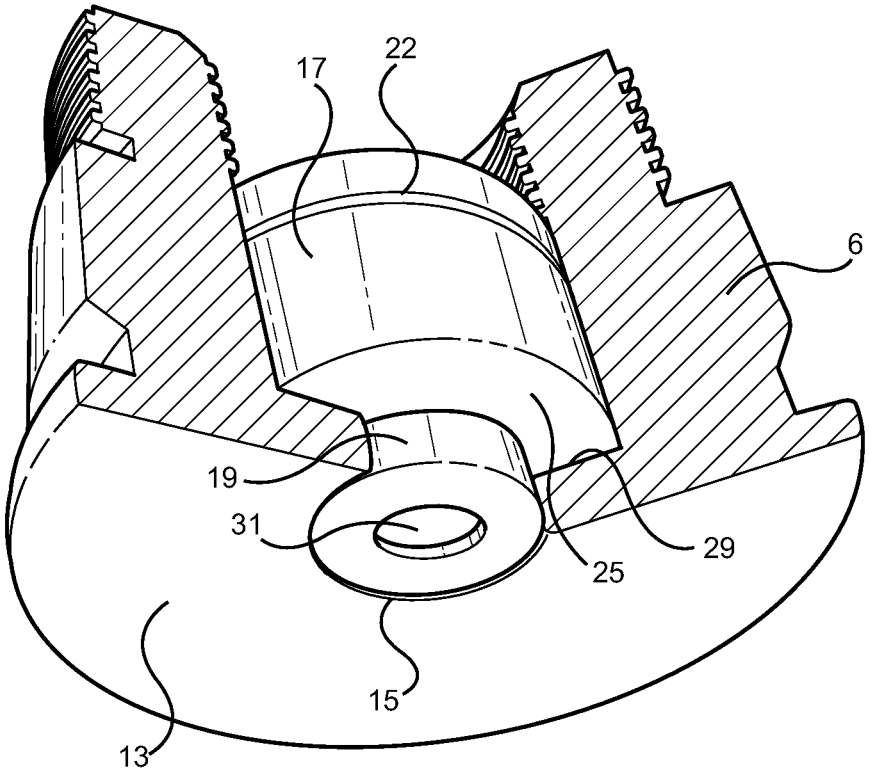
FIG. 8 is a bottom cut-away view of the base having a removable powder chamber.

FIGS. 6-8 show base 6 having primer flash hole end 13 having opening 15 adapted to receive powder chamber secondary end 19. Powder chamber secondary end 19 has opening 31 adapted to receive primer (not shown). FIGS. 7, 8, and 10 illustrate powder chamber 17 having set screw recess 22.

Figure 9:
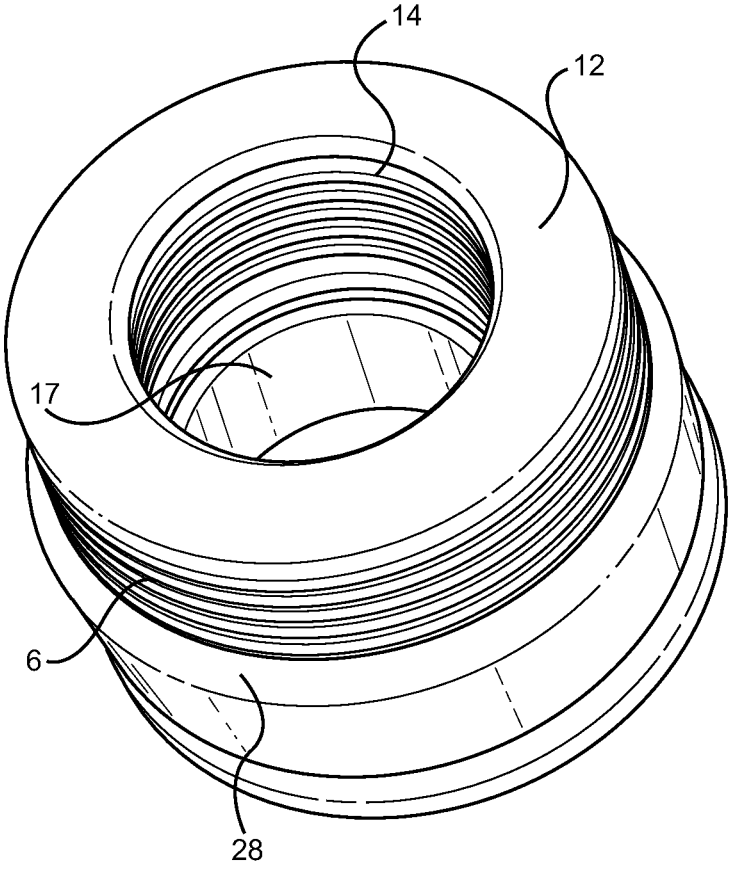
FIG. 9 is a top perspective view of the base having a removable powder chamber.

FIG. 9 illustrates base 6 having opening 14. Opening 14 receives powder chamber 17. Internal shell seating surface 12 is located on an end of base 6. Base 6 also has shell end seating surface 28.

FIG. 10 shows threaded insert 21 adapted to be screwed into base 6. Threaded insert secondary end 27 is adapted to come into contact with a surface of burst disk 20, thereby retaining burst disk 20 and powder chamber 17 to the inside of base 6.

Figure 11:
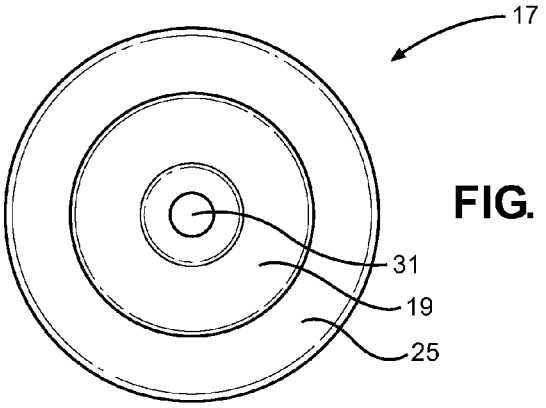
FIG. 11 is a bottom view of the removable powder chamber.
Figure 12:
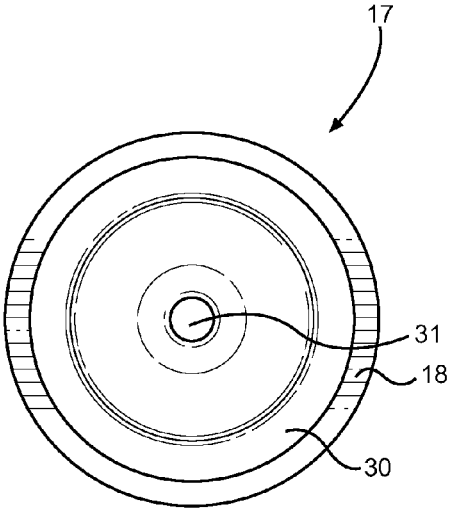
FIG. 12 is a top view of the removable powder chamber.

FIG. 11 shows powder chamber 17 having protrusion end 19 with opening 31(FIGS. 11 and 12) to receive a primer (not shown). Powder chamber 17 has powder chamber retainer seat 25. FIG. 12 shows powder chamber 17 having end 18 with opening 30 adapted to receive a propellant (not shown).

In addition to the aforesaid embodiments of munition 1, the reusable high pressure chamber assembly includes multiple additional improvements as well.

FIG. 10 shows an improved removable powder chamber 17 having a substantially cylindrical housing with protrusion end 19.

Another improvement is that burst disk 20 substantially covers powder chamber end 18 to create a seal. Threaded insert 21 is screwed into base 6 to retain burst disk 20 and powder chamber 17 within base 6. Threaded insert 21 has primary end 26 to receive any device or tool capable of rotating threaded insert 21 including, but not limited to, a socket, screw driver, wrench, or spanner.

Another improvement of powder chamber 17 is that it is constructed of a strong material including, but not limited to, 303 stainless steel. The configuration of powder chamber 17 is radiused and can withstand approximately 45,000 psi of pressure from the propellant within powder chamber opening 30.

These and other important objects, advantages, and features of the invention will become clear as this description proceeds.

An important object of this invention is the method of assembling munition 1 having removable powder chamber 17 including the steps of providing base 6 with end 12 having opening 14 located opposite end 13 having opening 15. Providing powder chamber 17 with primary end 18 having primary opening 30 located opposite protrusion 19 having opening 31. Inserting powder chamber 17 into opening 14 of base 6. Positioning protrusion 19 to connect with opening 15 of base 6, whereby, powder chamber retainer seat 25 is in contact with seating surface 29 of base 6. Pressing a primer (not shown) into opening 31 of protrusion 19. Measuring propellant (not shown) and loading powder chamber 17 opening 30 with propellant. Inserting copper burst disk 20 into opening 14 of base 6. Burst disk 20 substantially covers opening 30 of powder chamber 17. Providing threaded insert 21 with end 26 having opening 32 located opposite end 27 having openings 33A-33F. Threading threaded insert 21 into opening 14 of base 6. Threaded insert 21 is adapted to retain burst disk 20 against end 18 of powder chamber 17, whereby, threaded insert 21 retains burst disk 20 and powder chamber 17 within base 6.

Another important object of this invention includes the step of screwing at least one fastener 7 through set screw opening 16 of base 6 to contact a sidewall of powder chamber 17.

Another important object of this invention includes the step of connecting base 6 to shell housing 2. Shell housing 2 has discharge end 3 with opening 8 and shell end seat 4 with opening 9.

Additional objects include, but are not limited to, the provision of assembling munition 1 with removable powder chamber 17 wherein: inserting payload 11 into opening 8; loading payload 8 with projectiles (not shown); positioning payload 11 within shell housing 2; and inserting a barrier element (not shown) into opening 8 to substantially cover payload 8.

It will thus be seen that the objects set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

Now that the invention has been described.

The invention claimed is:

1. A munition, comprising:

a reusable housing assembly having a removable powder chamber;

said housing assembly comprising:

a housing having a first end located opposite a second end;

said first end of said housing having a first opening;

said second end of said housing having a second opening;

said powder chamber having a powder chamber first end located opposite a powder chamber second end;

said powder chamber first end having a powder chamber first opening;

said powder chamber second end having a powder chamber second opening;

said first opening of said housing configured to receive an end of said powder chamber; said powder chamber having a seat, whereby, said seat is configured to mate with a seating surface of said housing, whereby, said powder chamber having a protrusion, said protrusion received by said second opening of said housing;

at least one fastener, said at least one fastener is contacting a sidewall of said powder chamber;

a plate substantially covering said first opening of said powder chamber;

a retaining member having a retaining member first end, said retaining member first end having at least one retaining member opening;

said retaining member having a retaining member second end, said retaining member second end having at least one opening; and, said retaining member adapted to retain said plate against said first opening of said powder chamber, whereby, said retaining member retains said plate and said powder chamber within said housing.

2. The munition of claim 1, wherein said housing assembly comprising:

said housing connected to a shell casing, whereby, said shell casing having a first end located opposite a second end, said first end of said shell casing having a first opening, said second end of said shell casing having a second opening.

3. The munition of claim 1, wherein said shell casing having at least one groove of approximately lmm to 2 mm deep.

4. A method of assembling a munition having a removable powder chamber, comprising the steps of:

providing a housing having a first end located opposite a second end, said first end of said housing having a first opening, said second end of said housing having a second opening;

providing said powder chamber, said powder chamber having a powder chamber first end located opposite a powder chamber second end, said powder chamber first end having a powder chamber first opening, said powder chamber second end having a powder chamber second opening; said powder chamber second end having a protrusion;

inserting said powder chamber into said first opening of said housing, whereby, said protrusion is received by said second opening of said housing, whereby, said powder chamber having a seat, whereby, said seat is configured to mate with a seating surface of said housing;

installing a primer into said powder chamber second opening;

loading said powder chamber first opening with a propellant;

inserting a plate into said first opening of said housing, whereby, said plate substantially covers said powder chamber first opening;

providing a retaining member having a retaining member first end located opposite a retaining member second end, said retaining member first end having at least one retaining member opening, said retaining member second end having at least one retaining member opening; and, threading said retaining member into said first opening of said housing, whereby, said retaining member is adapted to retain said plate against said powder chamber first opening, whereby, said retaining member retains said plate and said powder chamber within said housing.

5. The method of assembling a munition having a removable powder chamber of claim 4, wherein, screwing at least one fastener through said housing to contact a sidewall of said powder chamber.

6. The method of assembling a munition having a removable powder chamber of claim 5, wherein, connecting said first housing to a second housing, said second housing having a first end of said second housing located opposite a second end of said second housing, said first end of said second housing having a second housing first opening, said second end of said second housing having a second housing second opening.

7. The method of assembling a munition having a removable powder chamber of claim 6, wherein, inserting at least one projective into said first end of said second housing.

8. The method of assembling a munition having a removable powder chamber of claim 7, wherein positioning said at least one projectile within said second housing.

9. The method of assembling a munition having a removable powder chamber of claim 8, wherein, inserting a barrier element into said first end of said second housing, whereby covering an end of said projectile.

10. The method of assembling a munition having a removable powder chamber of claim 4, wherein, connecting said first housing to a second housing, said second housing having a first end of said second housing located opposite a second end of said second housing, said first end of said second housing having a second housing first opening, said second end of said second housing having a second housing second opening.

11. The method of assembling a munition having a removable powder chamber of claim 10, wherein, inserting at least one projectile into said first end of said second housing.

12. The method of assembling a munition having a removable powder chamber of claim 11, wherein positioning said at least one projectile within said second housing.

13. The method of assembling a munition having a removable powder chamber of claim 12, wherein, inserting a barrier element into said first end of said second housing, whereby substantially covering an end of said projectile.

* * * * *